US007271397B2

(12) United States Patent
Bryden et al.

(10) Patent No.: US 7,271,397 B2
(45) Date of Patent: Sep. 18, 2007

(54) COMBINED CHEMICAL/BIOLOGICAL AGENT DETECTION SYSTEM AND METHOD UTILIZING MASS SPECTROMETRY

(75) Inventors: Wayne A. Bryden, Ellicott City, MD (US); Robert J. Cotter, Baltimore, MD (US); Scott A. Ecelberger, Woodbine, MD (US)

(73) Assignee: The Johns Hopkins University, Baltimore, MD (US)

( * ) Notice: Subject to any disclaimer, the term of this patent is extended or adjusted under 35 U.S.C. 154(b) by 208 days.

(21) Appl. No.: 10/515,300

(22) PCT Filed: Jul. 17, 2003

(86) PCT No.: PCT/US03/22313

§ 371 (c)(1),
(2), (4) Date: Nov. 19, 2004

(87) PCT Pub. No.: WO2004/013602

PCT Pub. Date: Feb. 12, 2004

(65) Prior Publication Data

US 2005/0247871 A1 Nov. 10, 2005

Related U.S. Application Data

(60) Provisional application No. 60/396,693, filed on Jul. 18, 2002.

(51) Int. Cl.
*H01J 49/44* (2006.01)

(52) U.S. Cl. ..... 250/427; 250/288

(58) Field of Classification Search ..... 250/427
See application file for complete search history.

(56) References Cited

U.S. PATENT DOCUMENTS

| | | | | |
|---|---|---|---|---|
| 4,728,796 | A | 3/1988 | Brown | |
| 5,206,508 | A | 4/1993 | Alderdice et al. | |
| 5,308,979 | A | 5/1994 | Villa-Aleman | |
| 5,668,370 | A | 9/1997 | Yano et al. | |
| 5,864,137 | A | 1/1999 | Becker et al. | |
| 6,274,866 | B1 | 8/2001 | Li | |
| 6,326,615 | B1 | 12/2001 | Syage et al. | |
| 6,515,279 | B1 | 2/2003 | Baykut | |
| 6,649,907 | B2 * | 11/2003 | Ebeling et al. | 250/288 |
| 7,022,981 | B2 * | 4/2006 | Kato | 250/288 |
| 2002/0092980 | A1 | 7/2002 | Park | |
| 2002/0121595 | A1 | 9/2002 | Sunner et al. | |
| 2003/0006369 | A1 | 1/2003 | Bryden | |

FOREIGN PATENT DOCUMENTS

| | | |
|---|---|---|
| WO | WO 01/93305 | 12/2001 |

* cited by examiner

*Primary Examiner*—David Vanore
(74) *Attorney, Agent, or Firm*—Francis A. Cooch

(57) ABSTRACT

A mass spectrometer is provided herein and is configured to have two ionization sources, in which a first ionization source, such as MALDI, ESI and the like, which is capable of providing in addition to ions a set of normally intractable desorbed neutrals that are ionized by a second EI source coupled with the first source.

29 Claims, 5 Drawing Sheets

PRIOR ART

COMBINED CHEMICAL/BIOLOGICAL AGENT DETECTION SYSTEM AND METHOD UTILIZING MASS SPECTROMETRY

CROSS-REFERENCE TO RELATED APPLICATION

This application claims priority to U.S. Provisional Application No. 60/396,693, filed Jul. 18, 2002, the contents of which are fully incorporated herein by reference.

BACKGROUND OF THE INVENTION

1. Field of the Invention

The present invention relates generally to mass spectrometry. More particularly, the present invention is directed to a mass spectrometer configured to handle volatile/non volatile samples, gas and solid phase sample introduction, and ionization methods appropriate to the full spectrum of molecular masses.

2. Description of the Related Art

Rapid and accurate identification of biological agents is essential in diagnosing diseases, anticipating epidemic outbreaks, monitoring food supplies for contamination, regulating bioprocessing operations. It is highly desirable not only to rapidly distinguish between related biological agents especially pathogenic agents, but also to unmistakably identify species and strains in complex matrices in general and, particularly, for the purpose of risk assessment in field situations.

Furthermore, the real threat from biological weapons as tools of modern warfare and urban terrorism is rising. Development of early detection, counter measures, and remediation technology is a high priority in many military, government and private laboratories around the world. Biological warfare (BW) agents such as *Bacillus anthracis* (anthrax), *Clostridium tetani* (tetanus), and *Clostridium botulinum* (botulism) are of critical concern since these spores are non-growing, heat-resistant, dehydrated, and resistant to extremes of temperature, pH, desiccation, radiation, and chemical agents. Due to their high stability, spores are difficult to stain using typical cell biology methods and, consequently, are challenging to detect and enumerate. This stability and difficulty with conventional detection methods, in turn, make them an attractive tool for use in BW weapons.

Relatively recently, mass spectrometric techniques have been developed for generating specific protein profiles for various biological agents. Mass spectrometry is an analytical technique in which atoms or molecules from a sample are ionized (usually positively) and separated according to their mass-to-charge ratio (m/z). The resulting mass spectrum is a record of the intensity of the signal as a function of m/z. The instrument used to record a mass spectrum is called a mass spectrometer. Because every compound has a distinct (though not necessarily unique) molecular weight and fragmentation pattern, mass spectrometers have a unique potential for the broadband detection and identification of chemical and/or biological agents.

A typical spectrometer has, among others, the following essential parts: the ionizer, detector and mass analyzer frequently provided with data-handling electronics. There are a number of different techniques and solutions for each of these parts.

One of the early-developed ionization techniques was Electron Impact Ionization (EI). The principle of the EI source is shown in FIG. 1 and includes a filament 10, which serves as a source of electrons 12. A target or anode 14 is positively charged with respect to the filament 10 and attracts electrons out of it. A repeller 16 is a positively charged electrode which pushes positive ions away from the filament 10 through a lens stack 18 including a series of increasingly more negative electrodes which accelerate the positive ions in such a way that they become focused into a relatively narrow beam. When a sample molecule enters the EI source, it is hit by the electrons 12 and is ionized.

Most low molecular weight organic molecules are introduced as neutral volatile samples (generally upon heating) and are charged or ionized by the electron impact (EI) method. EI mass spectra are generally interpretable and can be used to deduce the chemical structure.

EI, however, may be limited in its use. As molecules become larger and carry more polar functional groups, they also become less volatile. However, volatility is required for EI, because it is a gas phase ionization technique. Accordingly, while EI is suitable for detection of low molecular weight chemical agents, it may not be sufficiently efficient for the larger toxins and microorganisms that comprise potential biological threat agents.

While a number of other ionization techniques have been developed over the last two decades, two new methods: electrospray ionization (ESI) and matrix-assisted laser desorption/ionization (MALDI) are now the most commonly used for non-volatile biological samples.

ESI is an ionization technique for small amounts of large and/or labile molecules such as peptides, proteins, organometallics, and polymers and forms ions directly from a sprayed solution. A solution of the sample is sprayed though a needle having a certain potential, which causes the spray to be charged as it is nebulized. The droplets evaporate in a region maintained at a vacuum. As any other ionization technique, ESI may have certain limitations. For example, the sample to be analyzed must be soluble, stable in solution, polar, and relatively clean. These conditions can be arranged in a laboratory, but are difficult to set up in a real, field situation.

MALDI uses a pulsed laser to form ions from a matrix or substrate that is the initial absorber of the photon energy. MALDI is generally used with solid samples, specifically biological samples dissolved and co-crystallized with a UV-absorbing organic compound (matrix) such as nicotinic acid, 3-OH picolinic acid (HPA), 2, dihydroxybenzoic acid (DHBA) or a-cyano-4-hydroxycinnamic acid (CHCA). The mass spectrum of bacteria, virus and spores are generally quite complex, as these are not pure compounds but mixtures.

Because it is not known a priori which compounds from a microorganism will be desorbed, ionized and recorded in the mass spectra, interpretation is not at all straightforward One approach utilizes the different mass spectral patterns observed for different microorganisms in the development of a "library" to which unknown agent can be compared.

The MALDI-MS technique is based on the discovery that desorption/ionization of large, nonvolatile molecules such as proteins and the like can be made when a sample of such molecules is irradiated after being co-deposited with a large molar excess of an energy-absorbing "matrix" material, even though the molecule may not strongly absorb at the wavelength of the laser radiation. The abrupt energy absorption initiates a phase change in a microvolume of the absorbing sample from a solid to a gas while also inducing ionization of the molecule of the sample. The ionized molecules are accelerated toward a detector through a flight tube. Since all ions receive the same amount of energy, the time required for ions to travel the length of the flight tube is dependent on their mass. Thus low-mass ions have a shorter time of flight (TOF) than heavier molecules.

Accordingly, matrix-assisted laser desorption/ionization (MALDI) is most often used with a time-of-flight mass spectrometer, though interestingly, the earlier TOF instruments had pulsed electron impact source. While initially regarded as low mass range, low mass resolution instruments, time-of-flight (TOF) mass spectrometers now provide excellent mass resolution and mass ranges for proteins that extend into the hundreds of kilodaltons.

An exemplary TOF mass spectrometer carrying out MALDI is illustrated in FIG. 2 and operates in the following manner. Samples are deposited as solid solutions in an organic matrix on a sample plate or probe 20. The energy from a short (100 ps to 1 ns) pulsed laser 28 is absorbed by the matrix, resulting in desorption and ionization of sample molecules in the source region. The electric potential between the sample plate 20 and extraction grids 22 results in the acceleration of the ions forming an ion beam 26 into a drift region 24 with kinetic energies of $eV+\frac{1}{2}mv^2$, where V is the total accelerating potential, m is the mass of the ion, e the charge, and v the velocity. The flight time of an ion through the drift region 24 having a length D is:

$$t=(m/2\ \mathrm{eV})^{1/2}D$$

Thus, the flight time is proportional to the square root of the ion's mass/charge ratio. In actuality, the flight time is more complex, reflecting the different times to, initial energies $U_0$, and initial positions $s_0$ when the ions are formed, and is described as follows:

$$T=[(2\ \mathrm{m})^{1/2}/eE][(U_o+eE_s)^{1/2}\pm U_o^{1/2}]+\{[(2\ \mathrm{m})^{1/2}D]/2(U_o+eE_s)^{1/2}\}+t_o$$

Because $t_0$, $U_0$ and $s_0$ are distributions, the peaks representing a particular mass have a finite time width which limits the mass resolution: $R=m/\Delta m=t/2\Delta t$. To somewhat overcome a relatively low resolution in the TOF MS shown in FIG. 2, the drift region is configured to have a substantial distance, which increases the overall dimensions of the this device.

To improve the mass resolution and to reduce dimensions of the TOF MS shown in FIG. 2, a number of means have been developed. One of these is a TOF MS having a reflectron defining a reflecting region or ion mirror 30, as shown in FIG. 3. The reflecting region "d" 30 is a series of lenses that describe a retarding/reflecting electrical field that returns the ions along a path back toward the source. The reflecting voltage $V_R$ is generally slightly higher than the accelerating voltage V so that ions turn around just short of the back of the reflecting region or reflectron. Ions with the same mass but higher kinetic energies have higher velocities and spend less time in the drift region; however, they penetrate the reflecting region 30 more deeply and spend more time there. Thus, the total time spent by ions of different energies in forward $L_1$ and reverse $L_2$ directions of the drift region, and the reflecting region "d" 30, is given by:

$$t=(m/2\mathrm{eV})^{1/2}[L_1+L_2+4d]$$

Accordingly, the total time in the TOF MS provided with the reflectron is more nearly the same for ions of different kinetic energies than for the simpler linear time-of-flight instrument shown in FIG. 2. However, the single-stage reflectron shown in FIG. 3 provides only first order correction for the kinetic energy. Higher order energy corrections are possible using dual-stage, quadratic and other non-linear reflections.

Still a further technique improving mass resolution includes using pulsed extraction. The technique involves a short delay time between ionization and ion extraction that permitted ions to drift in the field-free on source. Upon application of the extraction pulse, the more energetic ions will be closer to the source exit and will move through a shorter portion of the accelerating field.

A further approach described to correct the mass dependence includes the TOF instrument, as discussed in reference to FIGS. 2 and 3 and, in addition, configured to use orthogonal extraction/acceleration of ions, as shown in FIG. 4. In this approach, the laser beam 30 irradiates a sample producing ions, which are tightly focused and accelerated along a direction 32 between a pair of electrodes (lens and collimator) 31, so that the distribution in their velocities (arising from their kinetic energy distribution) lies entirely along this direction. The ions are then directed into a volume from which they can be extracted in a direction 34 orthogonal to their initial direction 32.

To even further improve characteristics of the spectrometer, ions may also be additionally focused using the reflectron, which defines the reflecting region 30. Further means directed to improvement of mass resolution may include an RF quadruple ion guide diagrammatically shown as 29 in FIG. 5 and operative to improve focusing of the initial ion beam when a low pressure (1 mTorr) insert gas is used to promote collisional cooling of the ion velocities. The ion guide also makes it possible to utilize high-pressure (1-100 mTorr) sources, or atmospheric pressure sources via a capillary inlet. Because the quadrupole ion guide effectively cools ion kinetic energies, the ions entering the extraction chamber have no memory of their initial kinetic energies. Thus, the orthogonal acceleration mass spectrometer with an R ion guide may be used with almost any ionization source including ESI, MALDI, atmospheric pressure MALDI and EI. A disadvantage of the RF ion guide is that it has a limited mass/charge range. Thus, it has been most successfully used for the low mass ions produced by EI or with high mass multiply-charged ion species produced by ESI.

Improvement of the mass resolution is not the only problem associated with mass spectrometers. As briefly mentioned above, the geometry of the mass spectrometer is also very important Commercial time of flight mass spectrometers generally have drift lengths of the order of 1 meter or longer. Time-of-flight instruments have been miniaturized, specifically for the analysis of biological agents. Provided that the instrument dimensions can sustain high voltage, there is no loss of mass range or sensitivity, but the mass resolution is generally considerably less. For example, in the miniature instrument shown in FIG. 5, the drift length 40 is 3 inches and is floated at the potential of a dual channel plate detector. The sample plate 42 is pulsed to approximately 10 kV giving ions a total energy at the detector of approximately 11.keV. Mass resolutions of up to one part in 1200 have been obtained on this instrument for purified peptides. Mass resolution is less for the more complex biological mixtures that constitute bacteria, virus, and spores.

Thus, many of the known mass spectrometers utilizing various ionization methods may have, among others, the following limitations:

- selective mass resolution ability resulting in efficient detection of only a narrow group of biological and chemical agents; and
- substantial geometrical dimensions limiting the practical use of at least some of the mass spectrometers.

These problems were addressed by utilizing interchangeable ionization sources in commercial mass spectrometers.

Commercial magnetic and multiple sector instruments have generally been offered with interchangeable electron impact (EI), chemical ionization (CI), field desorption (FD) and fast atom bombardment (FAB) sources. The quadruple-based gas chromatography/mass spectrometer (GCMS) is generally equipped with EI and CI sources. Combination EI/CI sources have also been available, with the ability to select the ionization mode without physically changing the source. Examples of the above may be found in U.S. Pat. No. 5,668,370 which discloses a plurality of ion EI and CI sources, which operate in a mutually exclusive manner and U.S. Pat. No. 6,326,615 which discloses glow discharge and photo ionization sources functioning only simultaneously.

More recently, interchangeable (alternately operating) MALDI and ESI sources have become available for the time-of-flight, Fourier transform mass spectrometer (FTMS), the ion trap (ITMS) and hybrid instruments using combinations of quadruples or ion traps with a time-of-flight mass analyzer. Some of the known structures are configured to have these sources placed in different locations: the electrospray at the atmospheric side of the vacuum chamber, and the MALDI at an intermediate (milliTorr) region. However, both of these ionization techniques are utilized with non-volatile samples and would therefore not address the needs of combined chemical/biological agent detection. In addition, they have not offered the opportunity, or any perceived advantage, for simultaneous operation.

Furthermore, attempts to incorporate EI and Infrared laser desorption (IRLD) ionization sources in a single instrument were undertaken in the past. As disclosed by Dr. Robert J. Cotter, one of the inventors of the present invention, in "Time Resolved Laser Desorption Mass spectrometry", In. J. Mass Spectrom. Ion Phys. and Ion Processes, pages 49 and 54, respectively (1983), a combination of EI and IRLD was used to resolve some ionization and fragmentation mechanisms, but not analytically.

Furthermore, the mass range and resolution of the instrument, as disclosed in these publications, was limited for the following reasons. First, as is known, since there is no matrix in IRLD, very large ions remained undetected. Second, the IRLD and EI sources were used alternately. As a result, if used to detect biological agents, each of these sources would exhibit specific limitations, as discussed in detail above.

A need, therefore, exists for a single mass spectrometer addressing the full breadth of chemical and biological agents including volatile/non volatile samples, gas and solid phase samples, and configured to carry out a combination of EI and MALDI ionization methods appropriate to the full spectrum of molecular masses.

SUMMARY OF THE INVENTION

The objectives of the present invention can be attained by a TOF mass spectrometer for combined chemical/biological agent detection and identification that comprises a combined electron impact and MALDI ionization source for volatile and non-volatile sample analyses, respectively. Particularly, the inventive mass spectrometer operates in a mode, in which both EI and MALDI sources function simultaneously for the detection of marginally volatile chemical and biological markers, or for increasing fragmentation.

Accordingly, one of the advantages of the mass spectrometer of the present invention is its ability to compete favorably with most existing detectors specific for a small group of agents. However, in contrast to the existing detectors, mass spectrometer of the present invention is capable of handling the wide range of molecular weights, chemical properties (such as volatility) and complexity of both chemical and biological agents. In other words, using the inventive instrument to detect bioagents and some other compounds and mixtures, one gains access to additional diagnostic or structural information.

In accordance with another aspect of the invention, the TOF mass spectrometer of the present invention is configured to have the orthogonal acceleration geometry. With the orthogonal pulsing technique, any kinetic energy distribution in the primary ion beam is not coupled to the ion velocity component oriented in the direction of ion acceleration into the TOF tube drift region. The primary ion beam kinetic energy spread oriented along the beam axis only affects the location of ion impact on the planar detector surface, not the ion arrival time at the detector surface.

In accordance with another embodiment of the present invention, a MALD/EI TOF mass spectrometer is provided with a reflectron. Both the orthogonal and reflectron configurations do not negatively affect the ability of the inventive MALDI TOF mass spectrometer to detect a wide spectrum of chemical and biological agents.

It is, therefore, an object of the present invention to provide a TOF mass spectrometer configured to detect a wide spectrum of chemical and biological agents.

A further object of the present invention is to provide a TOF mass spectrometer incorporating MALDI and EI ionization sources capable of operating simultaneously.

Still another object of the present invention is to provide a TOF mass spectrometer with combined MALDI and EI sources and having a miniaturized geometry without detrimentally affecting the detection ability of the TOF mass spectrometer.

BRIEF DESCRIPTION OF THE DRAWINGS

The above and other objects, features and advantages will become more readily apparent from the following description accompanied by a group of drawings, in which.

DETAILED DESCRIPTION OF THE PREFERRED EMBODIMENTS

Figure 1:
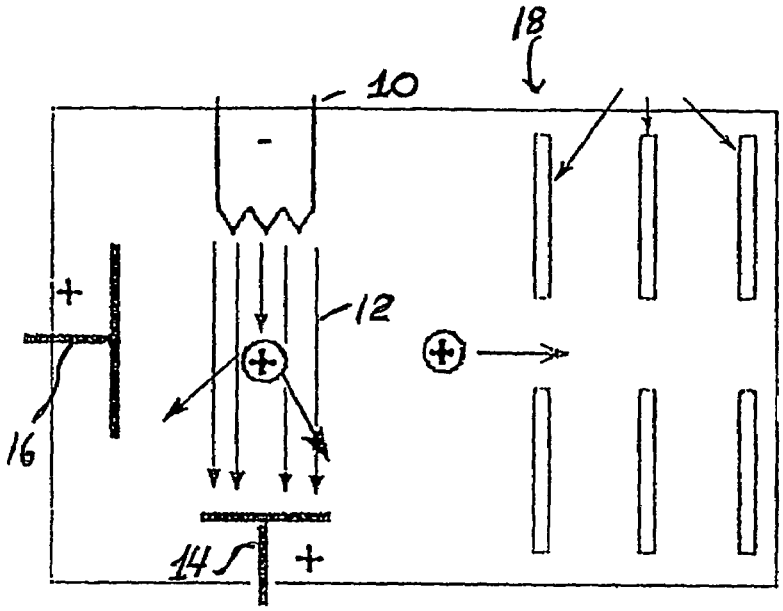
FIG. 1 illustrates schematics of an EI technique.
Figure 2:
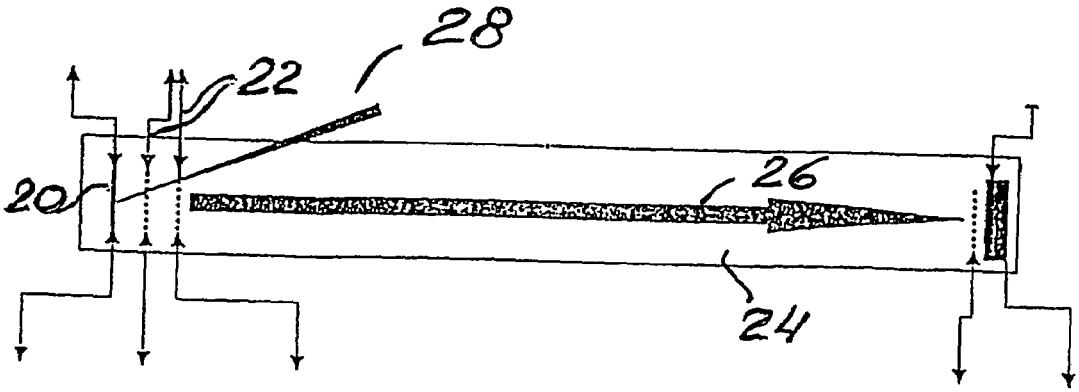
PRIOR ART FIG. 2
FIG. 2 illustrates a typical MALDI TOF mass spectrometer.
Figure 3:
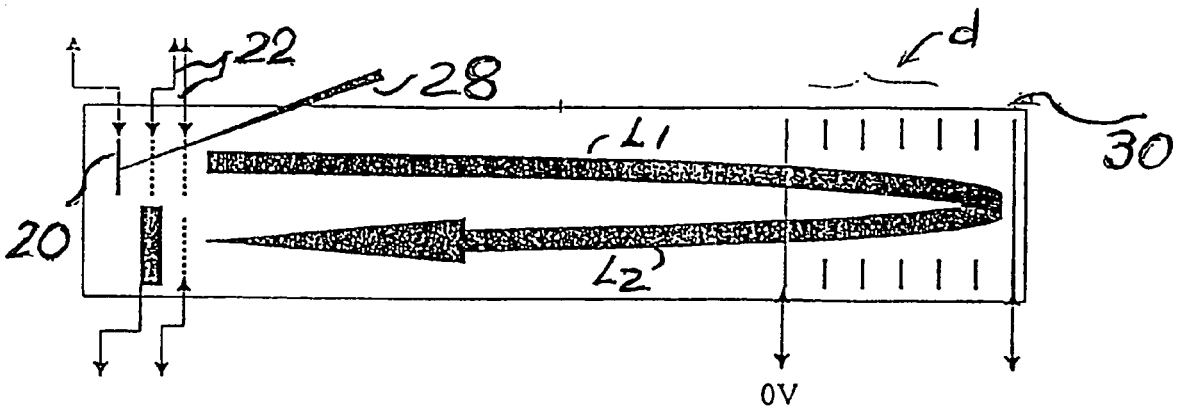
FIG. 3 illustrates a known TOF mass spectrometer provided with a reflectron.
Figure 4:
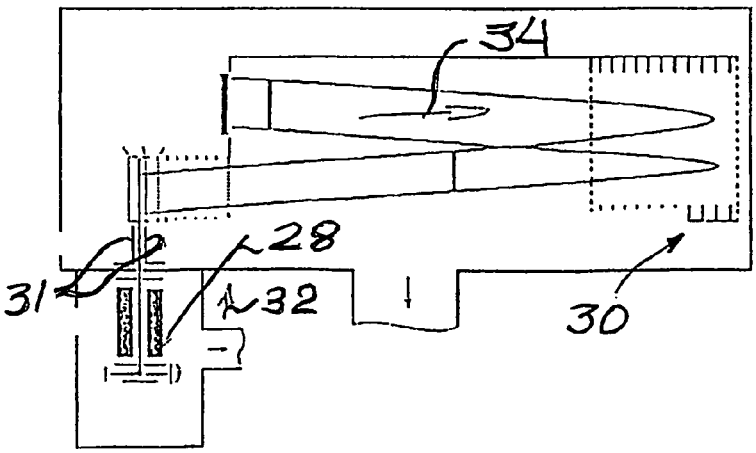
PRIOR ART FIG. 4
FIG. 4 illustrates a TOF mass spectrometer having the orthogonal acceleration geometry and a reflection, as known in the prior art.
Figure 5:
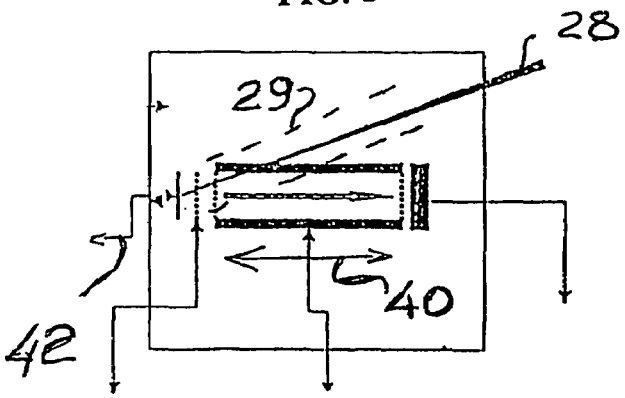
FIG. 5 illustrates another TOF mass spectrometer for biological detection configured in accordance with the prior art.
Figure 6:
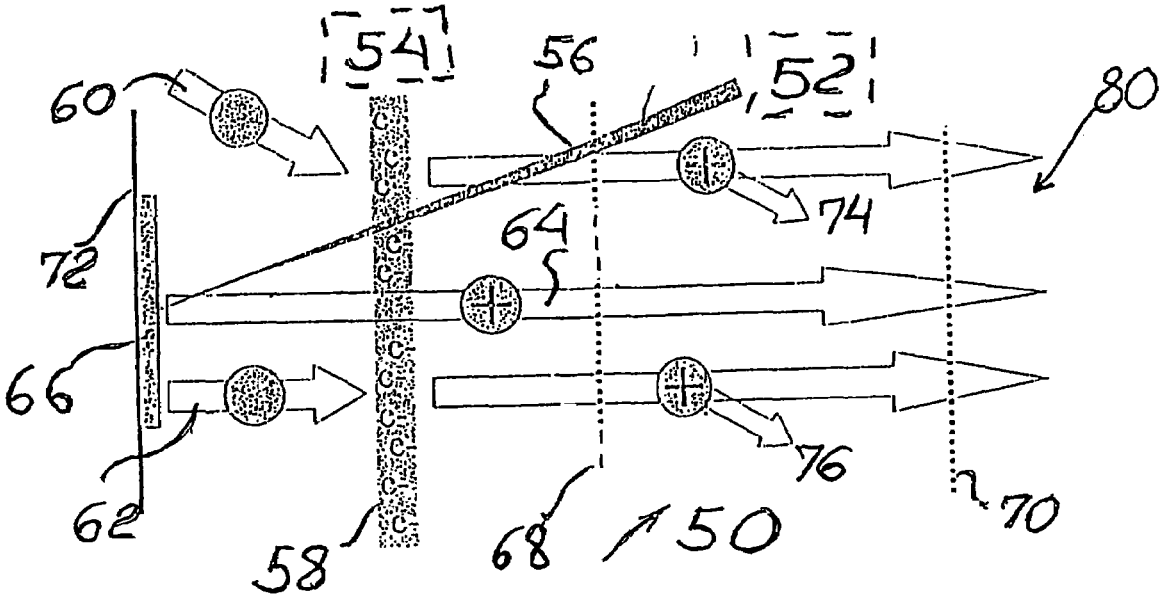
PRIOR ART FIG. 6
FIG. 6 illustrates an inventive TOF mass spectrometer provided with a combined MALDI/EI ionization sources.

Referring to FIG. 6, mass spectrometer 50 of the present invention is configured to have a MALDI ionization source 52 and an EI ionization source 54 used together to gain access to additional biological and chemical compounds not accessible by electron impact (i.e. not volatile) or desorbed by MALDI source 52. Thus, the mass spectrometer 50 is configured to carry out a method that increases specificity for correct bioagent identification either directly or by detecting additional biomarkers for biological agents. Although the following discussion relates mainly to a TOF mass spectrometer, it is understood that the TOF configuration is given only for the illustrative purposes of the inventive concept. Other configurations of the inventive instrument can include, but not limited to the quadrupole or triple quadrupole ion trap mass spectrometer, or hybrids such as quadrupole/time-of-flight QTOF, or a Fourier transform mass spectrometer (FTMS).

Figure 7:
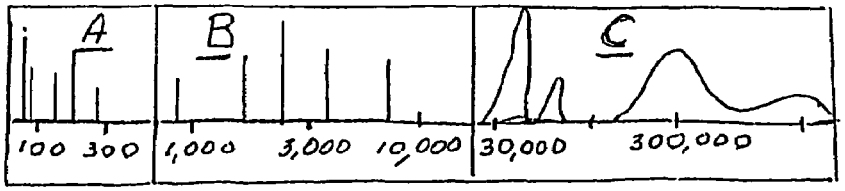
FIG. 7 illustrates mass regions detectable by the inventive MALD/EI TOF mass spectrometer of FIG. 6.

As illustrated in FIG. 7, mass spectrometer 50 is based on the inventive MALD/EI mode of operation capable of handling a broad spectrum of mass regions including chemical or matrix regions A, middle mass region B peptides, glycans and etc., as well as high mass region C proteins.

Specifically, the inventive TOF mass spectrometer 50, as illustrated in FIG. 6, is configured to have a sample backing plate 72, on which a solid or liquid sample 66, including microorganisms or non-volatile chemicals and toxins, is deposited with an appropriate organic matrix. The sample 66 is placed so that a laser beam 56, generated by the MALDI source 52, impacts upon the sample plate 72 to treat the sample 66 so that ionized particles and neutral particles are adsorbed from the sample 66 in correspondence with the MALDI technique. The MALDI or laser source 52 is not limited to any particular type or model and is subject to only one condition—it must work in combination with an electron beam source 54 to meet the objective of the invention. Thus, the laser source 52 can be a UV or IR laser; the most common lasers used in the MALDI technique are pulsed nitrogen lasers, with a wavelength of 337 mm, a pulse width of 600 ps to 1 ns, and pulse energies of 10 uJ to 1 mJ. Also common are Nd:YAG lasers with wavelengths of 256 or 353 nm, Er:YAG lasers with 2.94 micron wavelength, all having similar pulse widths and energies. Overall, there are no restrictions on sizes of the inventive spectrometer that can be both portable and stationary to meet the specific requirements.

Figure 8:
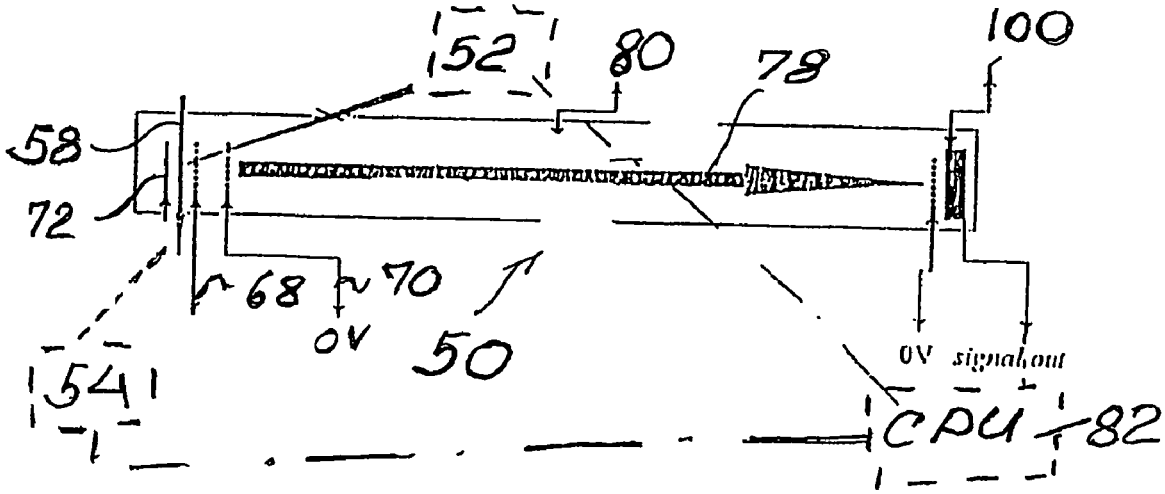
FIG. 8 illustrates one of embodiments of the inventive MALD/EI TOF mass spectrometer of FIG. 6.

At least three mechanisms may be simultaneously at work in mass spectrometer 50 configured to process the sample 66. First, the sample 66 is bombarded by the laser beam 56 causing the desorption of ionized particles 64, which are further accelerated into a drift region 80 toward a detector 100 (FIG. 8). Ions formed using this MALDI mode are generally even-electron protonated molecular species $MH^+$ undergoing comparatively little fragmentation as they are accelerated between multiple extraction grids or lenses 68, 70.

Second, gaseous samples 60 including volatile chemical agents from a gas chromatograph, adsorbant column or direct inlet and those volatile chemicals emitted from the sample 60 condense to the sample backing plate 72, are ionized by an electron beam 58 emitted by the electron beam source 54. Ions formed in this EI mode $$e^- + M \rightarrow M^+ + 2e^-$$

are generally odd-electron (radical) species with high internal energy that leads to fragmentation 74 as these ions are extracted along a path between the grids 68, 70.

Third, in the MALDI mode, some of desorbed particles 62, which are released from the sample 66, including the biological or toxin sample, are neutral. To process these neutral particles, the MS operates in the MALD/EI mode in which desorbed neutral molecules will be subsequently ionized in the gas phase by the electron beam 58 and further fragmented at 76.

Thus, the inventive mass spectrometer 50 has at least the following advantages over known instruments:

- for some protein and peptide biomarkers, the desorption of neutral molecular species may exceed that of ionized species, so that this mode may produce additional sensitivity,
- additional peptide and protein biomarkers that do not easily form ions in the desorption process may be observed,
- additional fragmentation will be observed from these radical ion species, and
- the MALD/EI mode may be utilized to bridge the region between the easily volatilized chemical agents and high molecular weight toxins.

In order to provide analytical coverage of the wide mass range that comprises chemical agents and the complex mixtures from microorganism the instrument must be able to transmit ions with high mass/charge ratio. In accordance with one embodiment of the invention shown in FIG. 8, the inventive mass spectrometer 50 has the linear geometry characterized by a linear one-way path of a focused ion beam of stream 78 composed of the molecules ionized at 64, 74 and 76. In operation, the EI source generates the electron beam 58 focused between the sample plate 72 and the extraction optics (grids or lenses) 68, 70 differently charged to have a potential difference therebetween. The laser source 52 generates the laser beam 56 impinging upon the sample 66 to cause the adsorption of initially ionized particles 64 forming along with gases 60 and neutrals 62 (FIG. 6), which are subsequently ionized by the EI beam 58, the ion beam 78 (FIG. 8). Upon acceleration between the extraction grids 68, 70, wherein the upstream grid 68 is charged and the downstream one 70 is grounded, the ionized particles and fragments thereof enter a drift vacuum region 80 as the focused ion beam of the stream 78 to be detected by the detector 100.

The corresponding mass spectrum output by the detector 100 is analyzed to determine if the biological or chemical agent of interest is present. The mass spectra may be analyzed in a traditional manner, for example, by an expert analyst viewing an oscilloscope (not shown) connected to the detector of the mass spectrometer 50. Alternatively, a controller (CPU) 82 may contain software that automatically identifies the threat by receiving the mass spectral data from the detector 100.

In the embodiment shown in FIG. 8, both the electron 58 and laser 56 beams are pulsed in response to synchronous control signals from the controller 82. Alternatively, the controller 82 may be configured to provide delayed extraction by any of the known time-dependent extraction techniques that can be used to improve mass resolution.

Figure 9:
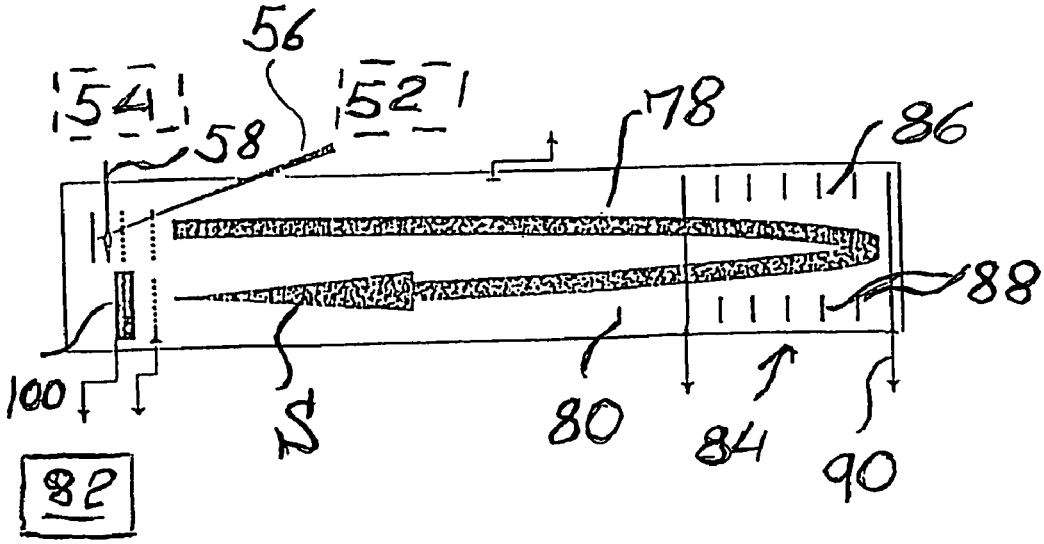
FIG. 9 illustrates a further embodiment of the inventive MALD/EI TOF mass spectrometer of FIG. 6.

FIG. 9 illustrates the mass spectrometer 50 incorporating a reflectron 84, which is located along a downstream path of the drift region 80. In use, the reflectron applies a voltage that increases with distance that the ion penetrates a reflecting region 86. Structurally, the reflectron 84 commonly comprises a series of equally spaced conducting rings 88 that form a retarding/reflecting field in which the ions penetrate, slow down gradually, and reverse direction, as illustrated by arrow S, thereby reflecting the ion's trajectory back along the incoming path. At the downstream end of the reverse ion beam path S, the detector 100 detects the ions and generates an output signal received and analyzed by the controller 82.

As is known, the variation in energy causes a spread in the measured mass for any one kind of ion. Ions with higher energy travel further into the reflecting region 86 before they are reflected by a downstream ring 90 (higher voltage), and so take longer to travel through the reflecting region. Of course, they travel faster outside the reflectron in the drift region along the reverse ion path S. Concomitantly, ions with lower energy but the same mass travel at a smaller distance in the reflecting region 86 and spend less time there before turning back. Thus, instead of continuing to disperse through the drift region (as in the linear TOF mass spectrometer), the reflectron imparts a focusing effect on the ions traveling in the drift region.

Figure 10:
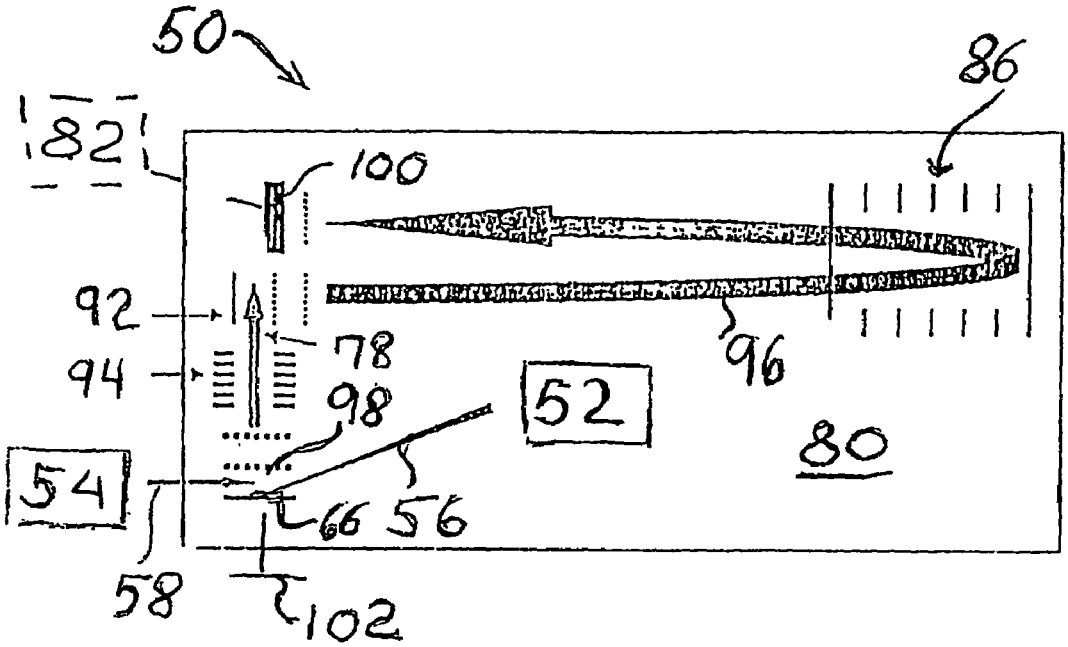
FIG. 10 illustrates still another embodiment of the inventive MALD/EI TOF mass spectrometer featuring the orthogonal acceleration geometry; and, FIG. 11 is a diagram illustrating EI orthogonal acceleration TOF mass spectrum of DMMP obtained by utilizing the inventive TOF mass spectrometer of FIGS. 5 and 6.

Still another embodiment of the inventive TOF mass spectrometer utilizing an orthogonal acceleration system is illustrated in FIG. 10. In accordance with the cardinal concept of the invention, irradiation of the sample 66 by the laser beam 56 will form the adsorbed ionized and neutral particles. The neutral particles or molecules as well as volatiles will be ionized in the central region of the initial portion of the focused ion beam of the stream 78 by focusing the electron beam 58 during the EI or MALD/EI mode. All the ions will be focused equally, since the orthogonal acceleration design is relatively insensitive to distributions in initial kinetic energies and space. As a result, the initially focused ion beam is accelerated along the upstream through a guide 94 towards the extraction chamber in which an orthogonal extraction system 92 is configured to apply the field so that the stream 78 changes its direction at a substantially 90° angle. Once the direction is changed, the stream 78 including all ionized particles and fragments thereof further flows along its downstream stretch 96 through the drift region 80 towards the reflecting region 86.

The "orthogonal" geometry is used to minimize effects of the kinetic energy distribution of the initial focused ion beam of the stream 78. With the orthogonal technique, any kinetic energy distribution in the initial focused ion beam is not coupled to the ion velocity component oriented in the direction of ion acceleration into the TOF tube drift region. The primary ion beam kinetic energy spread oriented along the beam axis only affects the location of ion impact on the planar detector surface, not the ion arrival time at the detector surface.

The guide 94 may contain electrostatic lenses including, but are not limited to, Einsel, accelerating/decelerating or steering lenses; thus the mass range is not limited. In a second configuration, the guide 94 may include an RF ion guide including a quadrupole one for ions with mass/charge below a cutoff value and higher mass ions focused electrostatically through the guide. In this embodiment, it is preferred that the electron beam 58 need not be pulsed.

Though samples 66 may be introduced both on the sample plate (or probe) 72 and in the gas phase, the TOF mass spectrometer 50 is envisioned primarily for use in analyzing chemical and biological samples presented in a single specific format in the location of the sample plate. In one configuration, the sample plate 72 is attached to an XY translatable sample stage 102 (FIG. 10) and supports an array of sample locations carrying high binding affinity to a range of chemical and/or biological agents. The combined EI, MALDI and MALD/EI source interrogates all of the volatile and nonvolatile species that are present and can be ionized.

In use, the controller 82 (which may be any digital control device, including a processor, microprocessor, PC, computer, microcomputer, etc.) provides control signals to the electron beam and laser sources 54, 52 and mass spectrometer 50 via signal conduits (for example, electrical wires). However, although the simultaneous operation of the MALDI and EI sources is critical for the purposes of this invention, it is envisioned that the TOF mass spectrometer can operate in either of the MALDI and EI modes or in a mode where these sources alternate to meet the specific requirements.

The controller 82 may include software that analyzes the agents of interest. Alternatively, the mass spectral output itself may be displayed to the user, who may be a mass spectral analyst trained to determine the presence or absence of compounds based on spectral lines.

Figure 11:
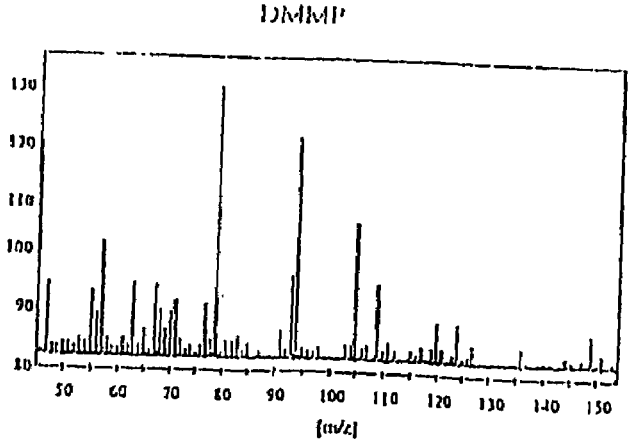

A plot made of m/z vs. the relative abundance is shown in FIG. 11. Quite frequently, the peak with the highest m/z represents the molecular ion, giving the molar mass of the compound. Since each compound has its own unique fragmentation pattern, by comparison to literature spectra, the identity of a compound can be determined.

The combined chemical/biological agent mass spectrometry detector can be miniaturized for portable use and retain excellent high mass resolution and mass range. Thus, FIG. 11 shows a mass spectrum of the simulant DMMP using a 40 cm orthogonal acceleration TOF mass spectrometer with an RF guide. Peak widths as narrow as 1.6 ns have been observed for ions in this mass range using a fast digitizer in the interleaving mode, and correspond to a mass resolution of 5,000 to 6,000.

Although illustrative embodiments of the present invention have been described herein with reference to the accompanying drawings, it is to be understood that the invention is not limited to those precise embodiments and can include, for example a structure configured to operate with a combined EI and ESI sources. Still another obvious modification includes the use of any type of mass spectrometer capable of utilizing MALDI and/or ESI techniques in combination with an EI source. Therefore, those skilled in the art will envision other modifications within the scope and spirit of the claims appended hereto.

What is claimed is:

1. A mass spectrometry method comprising the steps of:

(a) treating a sample deposited with a matrix to produce gaseous neutral particles and initially ionized particles capable of separation by mass spectrometry;

(b) directing the initially ionized particles along a path;

(c) subjecting the gaseous neutral particles to an electron beam located along the path for subsequent ionization thereof and for increasing fragmentation of the gaseous ionized particles, as the gaseous ionized particles advance along the path; and (d) subjecting the initially ionized and gaseous ionized particles and fragments thereof to mass spectrometry along the path to identify volatile and marginally volatile chemical and biological markers.

2. The mass spectrometry method of claim 1, wherein step (a) includes directing a laser beam at the sample, thereby utilizing a matrix assisted laser desorption/ionization (MALDI) technique.

3. The mass spectrometry method of claim 1, wherein step (a) includes utilizing an electrospray ionization (ESI) technique.

4. The mass spectrometry method of claim 2, wherein step (c) includes pulsing the electron beam synchronously with the laser beam.

5. The mass spectrometry method of claim 2, wherein step (c) includes pulsing the electron beam and the laser beam asynchronously.

6. The mass spectrometry method of claim 1, further comprising focusing the initially ionized and gaseous ionized particles and fragments to form a primary ion beam along an upstream of the path extending linearly and parallel to a downstream of the path.

7. The mass spectrometry method of claim 1, further comprising focusing the initially ionized and gaseous ionized particles and fragments to form a primary ion beam along an upstream of the path extending orthogonally to a downstream of the path.

8. The mass spectrometry method of claim 7, wherein the step (c) includes generating a continuous electron beam, which extends across the primary ion beam along the upstream of the path.

9. The mass spectrometry method of claim 7, further comprising the step of guiding the primary beam of the ionized particles and subsequently ionized particles and fragments by an ion guide selected from the group consisting of Einsel lenses, steering lenses, accelerating/decelerating lenses, an RF-ion guide and a combination thereof.

10. The mass spectrometry method of claim 1, further comprising accelerating the stream of the initially ionized and gaseous ionized particles and fragments along an upstream of the path defined between multiple extraction grids or lenses.

11. The mass spectrometry method of claim 1, further comprising reflecting the stream of the initially ionized and gaseous ionized particles and fragments along a downstream of the path along a direction, which is substantially opposite to a direction of the stream along an upstream of the path while subjecting the stream to mass spectrometry in step (d).

12. The mass spectrometry method of claim 11, wherein the step of reflecting the stream includes utilizing an electric field to reflect the ions located along the path between the upstream and downstream thereof.

13. The mass spectrometry method of claim 1, wherein the step of subjecting the stream of initially ionized, gaseous ionized particles and fragments to mass spectrometry includes detecting the initially ionized, gaseous ionized particles and fragments.

14. The mass spectrometry method of claim 13, further comprising obtaining a mass spectrum of the detected particles and fragments.

15. The mass spectrometry method of claim 1, further comprising introducing the sample in a liquid or solid state into a mass spectrometer provided with a combined ionization source including an El ionization source, which produces the electron beam, and at least one of MALDI/ESI sources producing the neutral particles.

16. A mass spectrometer comprising:

a sample holder configured to hold a sample deposited with a matrix;

a first ionization source operative to treat the sample to produce initially ionized particles and gaseous neutral particles;

an electron beam (El) source operative to ionize the gaseous neutral particles constituting with the initially ionized particles a stream of ionized particles directed along a path; and a mass analyzer system located along the path and operative to obtain a mass spectrum interpretable to deduce a wide range of molecular weights, volatility and complexity of chemical and biological agents contained in the sample.

17. The mass spectrometer of claim 16, wherein the first ionization source is selected from a laser beam source coupleable to the El source to define a MALD/El mode of operation, or an electrospray ionization (ESI) source coupleable to the El source to define a ES/El mode of operation.

18. The mass spectrometer of claim 17, wherein the laser and electron beam sources produce pulsed laser and electron beams, respectively.

19. The mass spectrometer of claim 17, wherein the El source produces a continuous electron beam.

20. The mass spectrometer of claim 16, wherein the sample is introduced in a solid phase or in a gas phase, the sample holder being controllably displaceable in XY directions.

21. The mass spectrometer of claim 17, further comprising an accelerating system configured to accelerate the stream of ionized particles and located along an upstream of the path downstream from the El source.

22. The mass spectrometer of claim 21, wherein the accelerating system is located along an initial stretch of the upstream of the path and has an array of differently charged grids or lenses spaced apart along the upstream extending parallel to or aligned with a downstream of the path to apply an electrical field to the stream of ionized particles.

23. The mass spectrometer of claim 22, wherein the electron beam source generates the electron beam focused between the sample holder and the accelerating system.

24. The mass spectrometer of claim 21, wherein the accelerating system is orthogonal to an initial stretch of the upstream and has an ion guide system configured to initially direct the stream along the upstream of the path, which extends orthogonally to a downstream stretch thereof.

25. The mass spectrometer of claim 24, wherein the accelerating system further comprises an array of differently charged grids or lenses located downstream from the ion guide system and configured to direct the stream of the initially ionized gaseous ionized particles along the downstream of the path.

26. The mass spectrometer of claim 24, wherein the ion guide system is selected from the group consisting of Einsel lenses, accelerating/decelerating lenses, steering lenses, a RE-ion guide and a combination thereof.

27. The mass spectrometer of claim 21, further comprising a reflectron located downstream from the accelerating system and configured to describe a retarding/reflecting field turning the stream of the initially ionized particles and gaseous ionized particles along a downstream of the path extending in a direction substantially opposite to a direction along which the stream advances along the upstream of the path.

28. The mass spectrometer of claim 16, further comprising a detection system located along a downstream stretch of the path and configured to intercept the stream of the initially ionized and gaseous ionized particles and to generate an output signal in response to detection.

29. The mass spectrometer of claim 28, wherein the mass analyzer system is coupled to the detection system and configured to receive the output signal to obtain and interpret the mass spectrum.

* * * * *